US007076899B2

(12) United States Patent
Pitcher et al.

(10) Patent No.: US 7,076,899 B2
(45) Date of Patent: Jul. 18, 2006

(54) EXTRUDED GRIP FRAME ARRANGEMENT

(75) Inventors: David Pitcher, Cambridge, MA (US); Thomas P. Burrous, Andover, MA (US)

(73) Assignee: Rose Displays, LTD, Salem, MA (US)

( * ) Notice: Subject to any disclaimer, the term of this patent is extended or adjusted under 35 U.S.C. 154(b) by 0 days.

(21) Appl. No.: 10/848,651

(22) Filed: May 19, 2004

(65) Prior Publication Data

US 2004/0211101 A1 Oct. 28, 2004

Related U.S. Application Data

(63) Continuation-in-part of application No. 10/440,923, filed on May 19, 2003, now Pat. No. 6,880,280, which is a continuation-in-part of application No. 09/820,069, filed on Mar. 28, 2001, now Pat. No. 6,678,982.

(51) Int. Cl.

| | |
|---|---|
| ***G09F 7/02*** | (2006.01) |
| ***G09F 7/06*** | (2006.01) |
| ***A47G 1/06*** | (2006.01) |

(52) U.S. Cl. ..... 40/611.02; 40/611.12; 40/790

(58) Field of Classification Search ..... 40/790, 40/791, 792, 793, 611.01, 611.02, 611.11, 40/611.12

See application file for complete search history.

(56) References Cited

U.S. PATENT DOCUMENTS

| | | | | |
|---|---|---|---|---|
| 4,512,094 | A * | 4/1985 | Seely | 40/791 |
| 4,835,891 | A * | 6/1989 | Joffe | 40/647 |
| 5,396,722 | A * | 3/1995 | Ostrovsky | 40/796 |
| 6,601,330 | B1 * | 8/2003 | Dusink | 40/792 |
| 2001/0042331 | A1 * | 11/2001 | Ostrovsky | 40/793 |

* cited by examiner

*Primary Examiner*—S. Joseph Morano
*Assistant Examiner*—Robert J. McCarry, Jr.
(74) *Attorney, Agent, or Firm*—Don Halgren

(57) ABSTRACT

An extruded snap frame panel arrangement assembly for the biased pinching of a display panel therewithin. The arrangement includes an elongated back frame plate, a front frame plate and an elongated S-shaped double curved snap plate integrally co-extruded with the back plate and front plate, for biasedly pinching the display panel therebetween. A separate cover plate is slidably attached to the S-shaped double-curved snap plate for providing a further bias to the pinching of the display panel.

13 Claims, 3 Drawing Sheets

EXTRUDED GRIP FRAME ARRANGEMENT

This invention relates to extruded components for the manufacture of picture frame assemblies and poster support assemblies, and is a continuation-in-part of U.S. patent application Ser. No. 10/440,923, filed May 19, 2003 now U.S. Pat. No. 6,880,280, which is a continuation-in-part application of my commonly assigned U.S. patent application Ser. No. 09/820,069, filed Mar. 28, 2001, 20 now U.S. Pat. No. 6,678,982 issued 20 Jan. 2004 each of which are incorporated by reference herein, in its entirety.

BACKGROUND OF THE INVENTION

1. Field of the Invention

2. Prior Art

Poster gripping assemblies have been known in the field, for a number of years. One such instance is shown in U.S. Pat. No. 4,519,152 to Seely et. al. which shows a tamper proof poster display arrangement. This display arrangement has an outer cover portion with certain defined angles which make it difficult to open the cover from its base. An "opener tool" is required for that. The cover and the base portions are independently extruded and have a hinge relationship which requires a difficult "slide together" assembly.

U.S. Pat. No. 4,937,959 to Palmer et. al. discloses a gripper extrusion arrangement wherein a front cover portion and a rear panel portion are separately extruded and mated together in another complicated hinge assembly. Inadvertent sliding between the front cover portion and the rear panel portion is prevented by a rather complicated discontinuity formed in the front panel which mates with a slot or the like in the rear panel. This requires further operations and unnecessary manufacturing costs.

U.S. Pat. No. 5,307,575 to Ivansson et. al. shows a frame corner assembly wherein adjacent sides of a frame are held together with a rather complicated bracket arrangement. The cover portions and rear panel portions are individually extruded and are snapped together. Alignment of the ends of these multiple component arrangements lead to inaccurate end mis-aligned corner sections.

U.S. Pat. No. 5,732,496 to Tanaka shows a sign frame with corner arrangements for attaching sides of that frame together. Mitered alignment of the corners is avoided by a corner insert which is somewhat more expensive to manufacture and adds a further step in that procedure.

U.S. Pat. Nos. 4,512,094; 4,512,095 and 4,523,400, all to Seely, disclose a hinged, plastic biased poster frame arrangement. None of these references however teach the use of a cover which physically applies a biasing force to facilitate and supplement the pinching of a poster in that frame arrangement.

It is an object of the present invention, to provide a poster gripping assembly which overcomes the disadvantages of the prior art.

It is a further object of the present invention to provide a poster gripping assembly which may in an alternative embodiment, be utilized in a poster-holding configuration by itself or in a frame construction of rectilinear configuration.

It is a further object of the present invention to provide a poster gripping assembly which simplifies the manufacturing operation over the prior art.

It is another object of the present invention to provide a poster gripping apparatus without a biasing spring arrangement required to permit adjustment of its bias.

It is a further object of the present invention to provide a two part frame assembly which is easily extruded and assembled.

It is a further object of the present invention to provide a frame assembly with a cover portion which provides a bias pressure against a display panel having to display unique decor, color or attention gathering characteristics.

It is yet still a further object of the present invention to provide a poster gripping assembly which may be assembled into a rectilinear frame construction with accuracy and simplicity while minimizing the likelihood of defects as may be associated with the prior art.

It is yet another object of the present invention to provide a multi-curved component which improves the biasing and holding of a panel held therewith.

BRIEF SUMMARY OF THE INVENTION

The present invention relates to a snap frame arrangement for the biased capture and support of a display panel within that snap frame arrangement. The snap frame arrangement may be arranged so as to show the display panel from one edge, or the snap frame arrangement may be arranged around its entire periphery, preferably in a quadrilateral configuration.

The freedom permitted in the use and assembly by the snap frame arrangement of the present invention is accomplished by an elongated extrusion which consists in cross-section, of an elongated back frame plate unitarily co-extruded with an elongated front frame plate. The elongated back frame plate is attached and parallel to the elongated front frame plate by an elongated connecting bridge portion co-extruded therewith. The bridge portion is preferably perpendicular to one edge of the back frame plate and also to one edge of the front frame plate.

The elongated back frame plate has an inner distal edge defining an inner side thereof. The elongated back frame plate has a slight sweeping curve thereto, directed towards the front frame plate. The front frame plate has an innermost edge with an elongated inner "J" portion extruded therewith. An elongated inner flange is disposed on the inner side of the bridge portion between the back frame plate and the front frame plate. The inner flange is arranged in an opposed relationship with respect to the edge of the inner "J" portion. The inner flange and the inner J portion define an elongated, generally "T"-shaped slot with respect to the front frame plate and the back frame plate, and is utilized to receive a corner bracket.

An outer flange extends perpendicularly with respect to the front frame plate and runs longitudinally therealong. The outer flange is spaced from the bridge portion between the back frame plate and the front frame plate by about one third of its height. The outer flange has a distal portion on which a first side arm is arranged from one side thereof. The first side arm has an angled extension forming an acute angle with respect to the first side arm. A curved outer gripping lip is arranged on the distalmost end of the angle extension. The curved outer gripping lip is arranged for support of a cover plate described hereinbelow. The distal end of the outer flange adjacent the first side arm, has an elongated living hinge co-extruded therewith.

An elongated double-curved snap plate of generally "S" shape in cross-section has a proximal edge which is connected to the living hinge. The "S" shaped curved snap plate defines, in an edge view, a curvilinear member comprised of an elongated convex face and an adjacent elongated concave face, the concave face having an elongated distalmost edge.

A second side arm is arranged at an acute angle with respect to the "S" shaped curved snap plate and extruded adjacent the distalmost edge. An elongated receiving channel is co-extruded on the distal edge of the second side arm. The elongated receiving channel, as will be described herein below, is arranged to articulably receive and enclosingly secure a lower lip of a cover plate. An elongated "T" shaped cover gripping lip is arranged on the distal edge of the curved receiving channel. The juncture of the "S" shaped, double-curved snap plate and the second side arm defines a locus of contact between the frame assembly and the display panel being supported thereon. An elongated low durometer pressure bulge is disposed adjacent the locus of contact of the "S" curved snap plate to provide a gripping mechanism of the "S" curved snap plate with respect to the planar display panel when the snap frame arrangement is in its closed configuration.

The snap frame arrangement includes a second component which is slidably removable and replaceable with respect to the back frame component thereof. The front panel and biasing cover plate comprises a generally J-shaped extrusion in cross section, the cover plate having an elongated curvilinear portion which pivotally encloses the curved gripping lip on the distal end of the first side arm. The curvilinear portion extends generally rearwardly of the front panel. The rear arm has a distal portion to which a curved gripping finger is arranged and attached thereto. The curved gripping finger has an arcuate curve of about two hundred degrees relative to the rear arm to define a pivotable gripping means. The curved gripping finger with its two hundred degree curve with respect to the rear arm defines a first channel therewithin. An elongated locking guide point is co-extruded on the rear arm on the side towards the distal edge of the curved gripping finger. The locking guide point provides a locking mechanism for the first channel when the front panel or cover plate is attached to the frame portion of the snap frame arrangement. A locking shoulder is co-extruded adjacent the locking guide point to minimize displacement of the components as they pivot with respect to one another. The front panel or cover plate has edge defined by an end flange arranged at an acute angle with respect to the backside of the front panel or cover plate.

An opposing "L" shaped flange is also co-extruded with the end flange and is in an opposing relationship with the distalmost edge of that end flange. The opposed flange and the end flange define a second "T" shaped channel between them. An inner surface of the second T=shaped slot provides an abutting surface to the planar face of the T-shaped cover gripping lip.

In the snap frame assembly arrangement, the elongated front panel or cover plate extrusion is slid onto the elongated back frame component with the first channel slideably receiving the curved outer gripping lip on the distalmost end of the angle extrusion on the first side arm. The second channel slideably receives the angled outer gripping lip disposed on the second side arm at the distalmost edge of the curved snap plate. The angled outer gripping the lip has a planar face and a heel which are pivotably movable with respect to the opposed flange defining one portion of the second T-shaped channel. When the "S" shaped curved snap plate is biased inwardly against the back frame plate and any panel display disposed thereadjacent, the front cover panel pushes against the angled outer gripping lip and arcuately moves the S-shaped curved snap plate towards that back frame plate and the display panel. Once the location of the angled outer gripping lip is closer towards the back frame plate that is the line between the curved outer gripping lip and the living hinge, the locus of contact and the elongated pressure bulge are biased against that display panel. The heel of the angled outer gripping lip and the planar face thereof also at that locus will mate with the inner surface of the second channel for full pressure biased thereagainst.

The invention thus comprises an extruded snap frame panel arrangement assembly for the biased pinching of a display panel therewithin. The assembly comprises an elongated back frame plate, a front frame plate and an S-shaped curved snap plate integrally co-extruded with the back plate and front plate, for biasedly pinching the display panel therebetween. A separate cover plate is slidably attached to the S-shaped double curved snap plate for providing a supplemental, improved bias to the pinching of the display panel. The back frame plate has a curve therein to bias against a display panel pinched by the assembly. The back frame plate and the front frame plate are integrally connected by a bridge member extending transversely therebetween.

The S-shaped double curved snap plate is attached to the front frame plate by an elongated living hinge co-extruded therewith. A curved gripping lip is arranged to extend off of a side portion of the front frame plate, and an angled outer gripping lip is arranged on a distalmost edge of the snap plate. The angled outer gripping lip is arranged to move arcuately with respect to the curved outer gripping lip by pivoting about the elongated living hinge. The cover plate has a first edge with an elongated first channel thereon, and the cover plate has a second edge with an elongated second T-shaped channel thereon. The first channel of the cover plate slides onto the curved gripping lip and the second T shaped channel of the cover plate slides onto the T-shaped cover gripping lip. The T-shaped cover gripping lip has a planar face which pivots within the T-shaped second channel. The T-shaped cover gripping lip has an edge which engages an opposed flange of the second T-shaped channel to maintain securement of the cover plate and the movable attachment of the cover plate to the S-shaped snap plate. The first channel has an elongated guide point to maintain the curved outer gripping lip within the first channel on the cover plate. The planar face on the angled outer gripping lip lies flat against the T-shaped second channel when the snap frame arrangement is in a closed configuration. The elongated curved gripping lip on the first side arm and the elongated T-shaped cover gripping lip define a first plane, and the elongated living hinge lies outside of the first plane when the snap frame arrangement is in a closed configuration.

The invention may also comprise a method of supporting a display panel in a biased flat orientation comprising one or more of the following: providing an elongated forwardly-curved back frame plate and an elongated double curved snap plate in an integrally connected configuration; sliding an elongated cover plate onto the double-curved snap plate; inserting an elongated display panel onto a front face of the back frame plate; and pivoting the double-curved snap plate towards the forwardly-curved back plate about an elongated primary hinge arranged therebetween to provide an increased bias on the display panel between the back frame plate and the snap plate. The method may include: biasing the curved back frame plate against the display panel to provide a pinching therebetween and maintain the display panel in a flat condition; rotating a first channel and a second channel of the cover plate about an elongated curved outer gripping lip and an elongated T-shaped gripping lip respectively as the snap plate is pivoted about the primary hinge; biasing the double-curved snap plate into a closed pinching configuration against a display panel by biasing the cover plate against the double-curved snap plate.

BRIEF DESCRIPTION OF THE DRAWINGS

The objects and advantages of the present invention will become more apparent, when viewed in conjunction with the following drawings in which.

DESCRIPTION OF THE PREFERRED EMBODIMENTS

Figure 1:
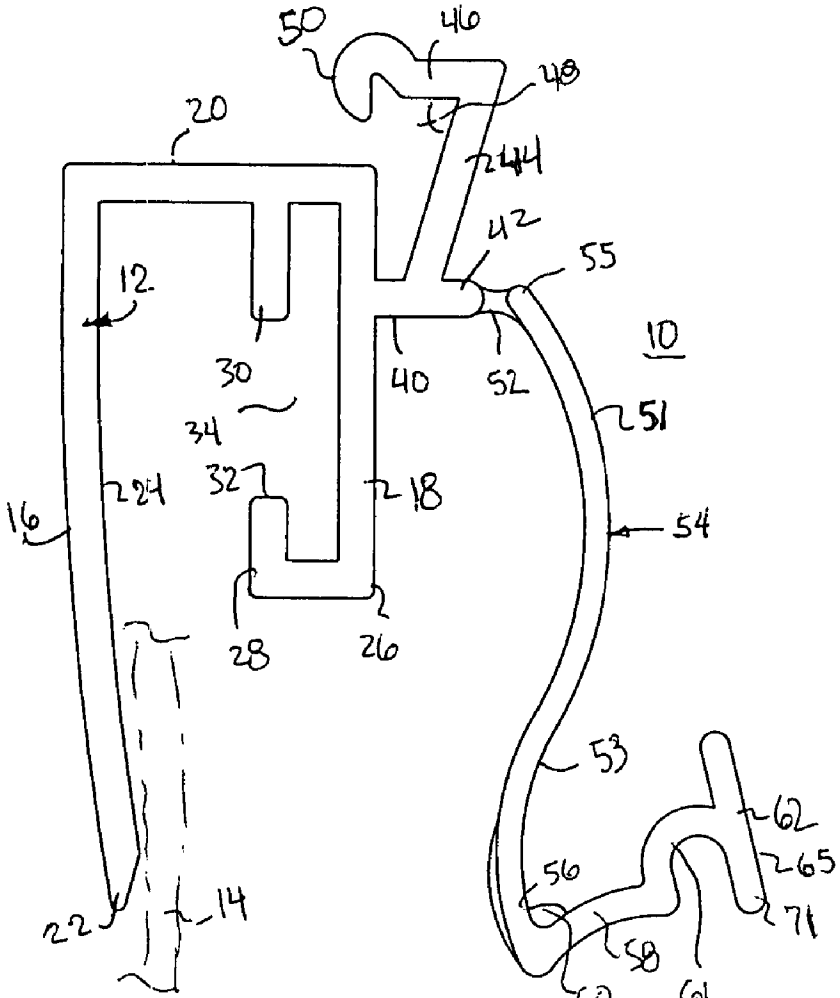
FIG. 1 is an end view of a back frame arrangement for the snap frame assembly of the present invention.

Referring now to the drawings in detail, and particularly to FIG. 1, there is shown an extruded back part 12 of the present invention which comprises a snap frame arrangement 10 (shown assembled in FIG. 3 et seq.) for the biased capture and support of a display panel 14 within that snap frame arrangement 10. The snap frame arrangement 10 may be arranged so as to show the display panel 14 from one edge, or the snap frame arrangement 10 may be arranged around its entire periphery, preferably in a quadrilateral configuration, shown partially enclosed in FIG. 6.

The snap frame arrangement 10 of the present invention includes a elongated extrusion which consists in cross-section, of a back frame plate 16 unitarily co-extruded with a front frame plate 18, as shown in FIG. 1. The back frame plate 16 is attached and parallel to the front frame plate 18 by a connecting bridge portion 20 co-extruded therewith. The bridge portion 20 is preferably perpendicular to one edge of the back frame plate 16 and also to one edge of the front frame plate 18.

The back frame plate 16 has an inner distal edge 22 defining an inner side 24 thereof. The back frame plate 16 has a slight curve thereto, directed towards the front frame plate 18, as may be seen in FIGS. 1 and 3 to 5, to provide a gripping and pressure bias against a display panel 14 and the front component described hereinbelow. The front frame plate 18 has an innermost edge 26 with an inner "J" portion 28 extruded therewith.

An inner flange 30 is disposed on the inner side of the bridge portion 20 between the back frame plate 16 and the front frame plate 18. The inner flange 30 is arranged in an opposed relationship with respect to the distalmost edge 32 of the inner "J" portion 28. The inner flange 30 and the inner "J" portion 28 define a generally "T" shaped slot 34 with respect to the front frame plate 18 and the back frame plate 16, and is utilized to receive a corner bracket (not shown for clarity).

An outer flange 40 extends perpendicularly with respect to the front frame plate 18 and runs longitudinally thereal-ong, as may be best seen FIG. 1. The outer flange 40 is spaced from the bridge portion 20 between the back frame plate 16 and the front frame plate 18 by about one third of the width of the "T" shaped section 34. The outer flange 40 has a distal portion 42 on which a first side arm 44 is arranged from one side thereof. The first side arm 44 has an angled extension 46 forming an acute angle 48 with respect to the first side arm 44.

A curved outer gripping lip 50 is arranged on the distal-most end of the angled extension 46. The curved outer gripping lip 50, which defines a pivot point, is arranged for support of a cover plate 68 described hereinbelow. The distal end 42 of the outer flange 40 adjacent the first side arm 44, has a primary "living hinge" 52 co-extruded therewith, and is co-extrudedly attached to and between the distal end 42 of the outer flange 40 and a curved snap plate 54. The "living hinge" 52, shown in cross section in FIG. 1, is also co-extruded with both the back frame 12 and the snap plate 54.

An elongated double-curved snap plate 54 of generally "S" shape in cross-section has a proximal edge 55 which is connected to the living hinge 52. The "S" shaped curved snap plate 54 defines, in an edge view, a curvilinear member comprised of an elongated convex face 51 and an adjacent elongated concave face 53, the concave face 53 having an elongated distalmost edge 56.

A second side arm 58 is arranged at an acute angle 60 with respect to the distal edge 56 of the "S" shaped curved snap plate 54. An elongated receiving channel 61 is co-extruded on the distal edge of the second side arm 58. The elongated receiving channel 61, as will be described herein below, is arranged to articulably receive and enclosingly secure a lower lip 100 of the cover plate 68. An elongated "T" shaped cover gripping lip 62 is arranged on the distal edge of the curved receiving channel 61. The juncture of the "S" shaped, double-curved snap plate 54 and the second side arm 58 defines a locus of contact between the frame assembly 10 and the display panel 14 being supported thereon. An elongated low durometer pressure bulge 66 is disposed adjacent the locus of contact of the "S" curved snap plate 54 to provide a gripping mechanism of the "S" curved snap plate 54 with respect to the planar display panel 14 when the snap frame arrangement 10 is in its closed configuration.

The living hinge 52 functions as the locus of flexure or second pivot point/joint, about which the snap plate 54 pivots. The living hinge 52, the back frame 12 and the snap plate 54 cure all co-extruded simultaneously for minimization of costs and simplicity in subsequent component assembly. The plastic material comprising the primary hinge 52 is a softer plastic of a lower durometer (its softness and/or hardness typically expressed as a number on one of a number of Durometer Scales). The living hinge 52 is able to "bow" or bend somewhat, to accommodate the dimensional compression that the rigid "J"-shaped cover plate 68, described in more detail hereinbelow, affects as the components (especially snap plate 54 and hinge 52) swing through their respective arcs, upon closure or opening of the snap frame arrangement 10. This construction also eliminates the need for a spring within the assembly, as is common in the prior art, and permits mitered cuts at corners without concern for springs common in the prior art.

The distal end 71 of the T-shaped cover gripping lip 62, is receivably engaged in a distal corner 69 of the "J" shaped cover plate 68, and comprises a third pivot point for the snap frame arrangement 10. Once the three pivot points/joints are in planar alignment, the primary hinge 52 is at maximum bowing or compression. Once out of planar alignment, the double-curved S-shaped snap plate 54 is either biased toward or away from the frame plate 16, depending upon whether the third pivot point 71 is out and away from planar alignment or "between" planar alignment and in gripping contact with a display panel 14.

Figure 6:
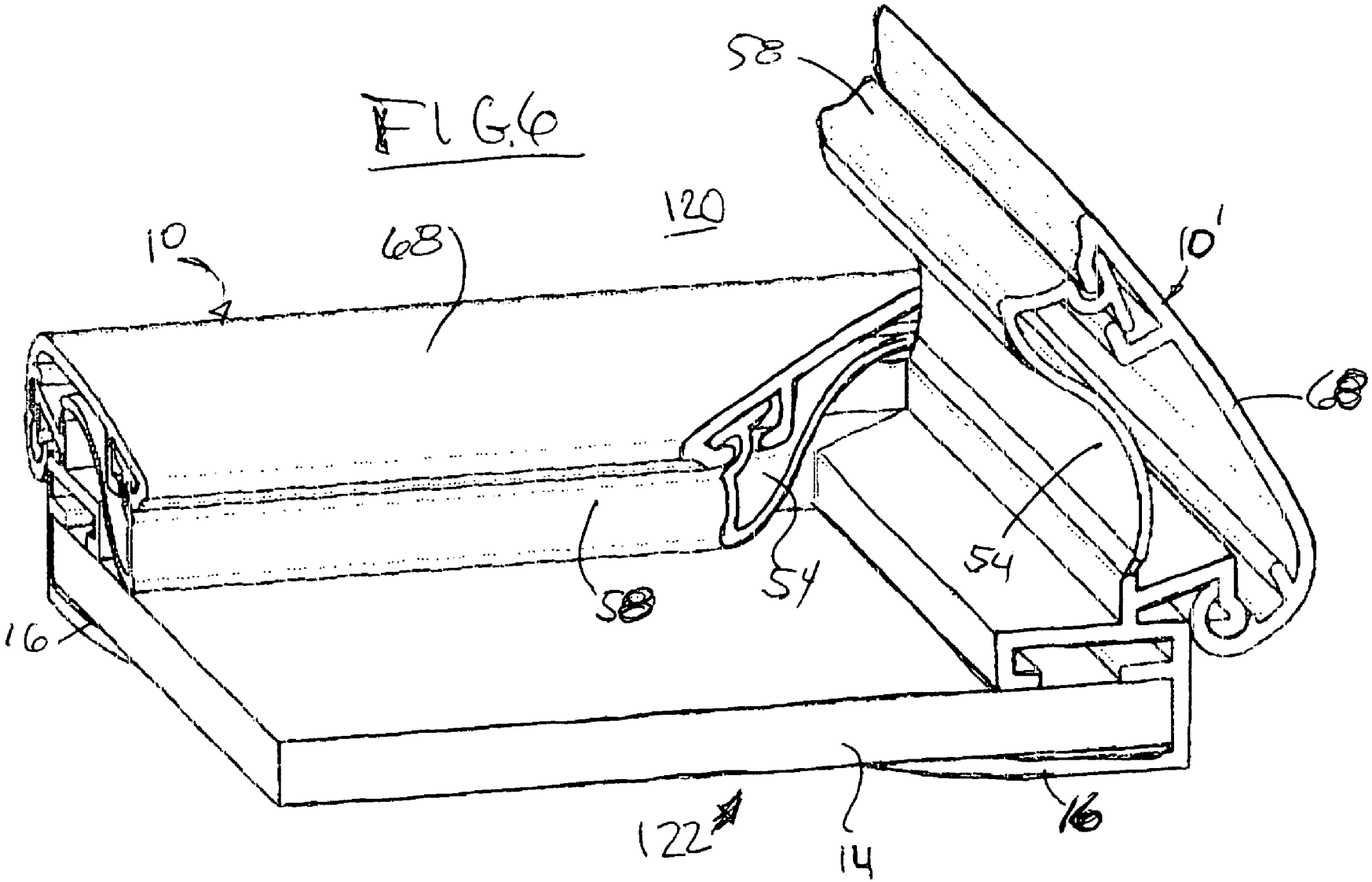
FIG. 6 is a partial perspective view of a pair of back frame components and front panels connected in a corner arrangement, with a display panel inserted therewithin.

The juncture (distalmost edge portion 56) of the curved snap plate 54 and the second side arm 58 defines a locus of contact between the frame assembly 10 and the display panel 14 being supported thereon. An elongated pressure bulge 66 is disposed adjacent/on the "locus of 'panel-contact' line" of the curved snap plate 54 to provide a gripping mechanism of the curved snap plate 54 with respect to the planar display panel 14 when the snap frame arrangement 10 is in its closed configuration, as represented in FIG. 6.

Figure 2:
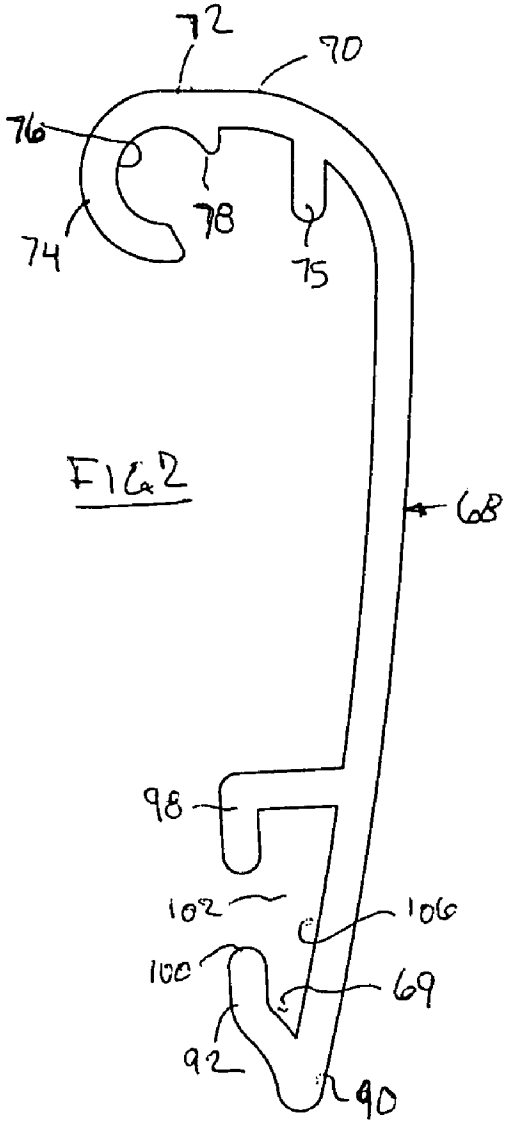
FIG. 2 is an end view of the front panel or cover plate of the snap frame arrangement constructed according to the snap frame assembly of the present invention.

The snap frame arrangement 10 includes a second component which is a rigid front panel/biasing cover plate 68, mentioned hereinabove, (i.e. metal or plastic) that is slidably assembled with respect to the back frame 12 component thereof. The front panel and biasing cover plate 68 comprises a generally J-shaped extrusion as shown in cross section in FIG. 2, the cover plate 68 having an elongated curvilinear edge portion 70 which connects to a rear arm 72 of the cover plate 68. The rear arm 72 extends in a generally rearwardly direction from the front panel 68. The rear arm 72 has a distal portion to which a cured grinning finger 74 is co-extrudedly arranged and attached thereto. The curved gripping finger 74 has an arcuate curve of about two hundred degrees relative to the rear arm 72. The curved gripping finger 74 with its two hundred degree curve with respect to the rear arm 72 defines a first channel 76. An elongated locking guide point 78 is co-extruded on the rear arm 72 on the side towards the distal edge of the curved gripping finger 74. The locking guide point 78 provides a locking mechanism for the first channel 76 when the front panel or cover plate 68 is attached to the frame portion 16 of the snap frame arrangement 10. The front panel or cover plate 68 has a second edge 90, parallel to the gripping finger 74, and is defined by a short end flange 92 arranged at an acute angle 94 with respect to the backside 96 of the front panel or cover plate 68. An elongated locking shoulder 75 is co-extruded adjacent the elongated locking point 78 to minimize displacement of the components as they pivot with respect to one another.

An opposing "L" shaped flange 98 is also co-extruded with the end flange 92 and is in an opposing relationship with the distalmost edge 100 of that short end flange 92. The opposing flange 98 and the end flange 92 define a generally "T" shaped second channel 102 between them. An inner planar surface 106 provides an abutting surface for the planar surface to the planar face of the "T" shaped cover gripping lip 62.

Figure 3:
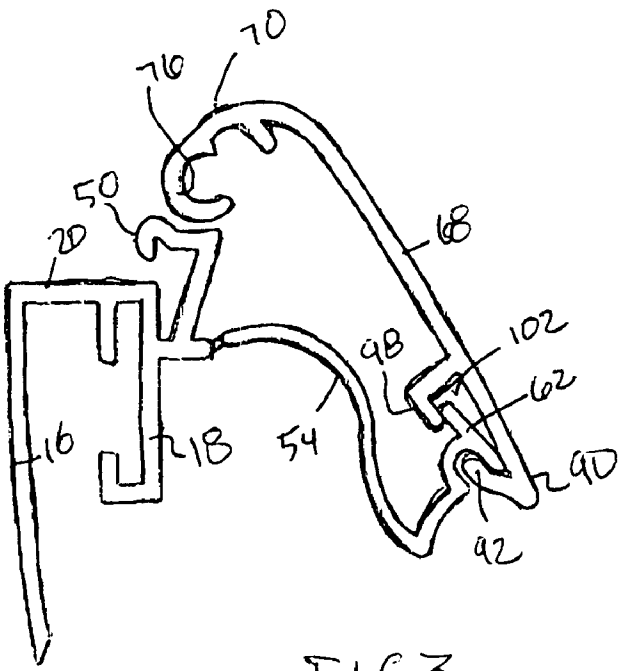
FIG. 3 is an end view of the back frame component and the front panel or cover plate assembled together at a lower edge thereof.

In the snap frame assembly arrangement 10, the elongated, rigid front panel or cover plate 68 extrusion is slid onto the elongated back frame component 16 with the second channel 102 slideably receiving the T-shaped cover gripping lip 62, as represented in FIG. 3. The first channel 76 on the rear arm 72 of the cover plate 68 is placed about the curved outer gripping lip 50, as represented in FIG. 4.

Figure 5:
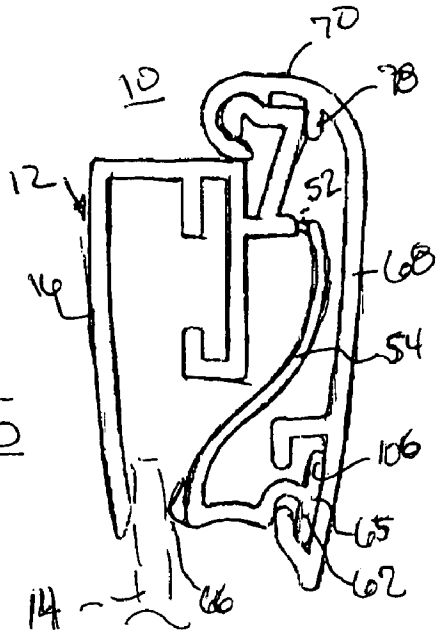
FIG. 5 is an end view of the back frame component and the front panel or cover plate in a generally closed configuration.
Figure 4:
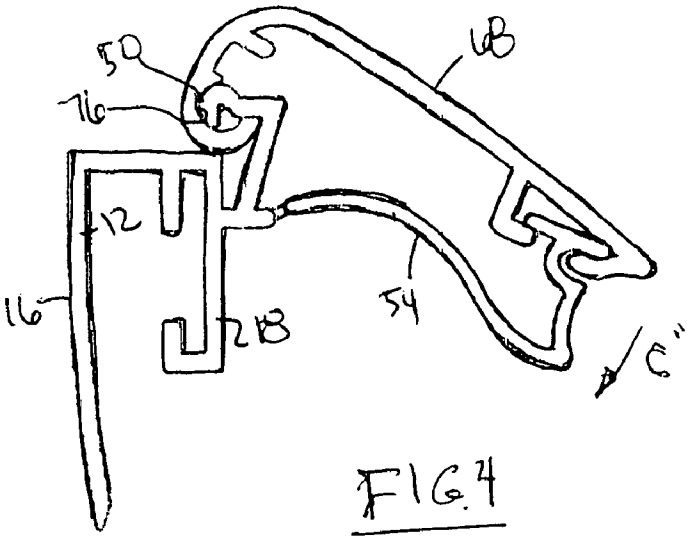
FIG. 4 is an end view of the back frame component and the front panel or cover plate fully attached to one another in an open configuration.

When the double-curved S-shaped snap plate 54 is biased inwardly against the back frame plate 16 and any panel display 14 disposed thereadjacent, the front cover panel 68 moves in a closing direction as indicated by arrow "C" in FIG. 5, and pushes against the T-shaped outer gripping lip 62, thus arcuately moving the curved snap plate 54 towards that back frame plate 16 and the display panel 14, as shown in the closed configuration in FIG. 4.

Once the location of the angled outer gripping lip 62 is closer towards the back frame plate 16, that is the line between the curved outer gripping lip 50 and the living hinge 52, the locus of contact and the elongated bulge 66 is biased against that display panel 14, as shown in FIG. 4. The edge 71 of the angled outer gripping lip 62 and the planar face 65 thereof also at that locus will mate with the inner surface 106 of the second channel 102, as represented in FIG. 5, for full pressure biased thereagainst. The snap frame arrangement 10 will have moved about the three elongated hinge points, which are the living hinge 52, the outer gripping lip 50 and the distal end 71 of the outer gripping lip 62.

FIG. 6 shows a perspective view of a first frame arrangement 10 and a second frame arrangement 10' joined at a ninety degree angle to define a corner 120 of a frame assembly 122. A display panel 14 is shown biased by the first frame arrangement 10, while the second frame arrangement 10' is shown in its pre-pinching orientation. Such a frame assembly 122 would typically have four frame arrangements 10 disposed in a rectangle, to secure a display panel between them.

We claim:

1. An extruded snap frame panel arrangement assembly for the biased pinching of a display panel therewithin, comprising:

an elongated back frame plate, a front frame plate and a curved snap plate which is integrally co-extruded with said back frame plate and said front plate, for biasedly pinching said display panel therebetween, wherein said curved snap plate has a generally "S" shape in cross-section, and wherein said curved snap plate is attached to said front frame plate by an elongated living hinge co-extruded therewith; and a separately extruded cover plate slidable longitudinally for attachment onto said curved snap plate for providing a further bias to said pinching of said display panel.

2. The extruded snap frame panel arrangement as recited in claim 1, wherein said curved snap plate has a double curve therein.

3. The extruded snap frame panel arrangement as recited in claim 1, wherein said curved snap plate has a distal edge with a panel engaging surface thereon.

4. The extruded snap frame panel arrangement as recited in claim 3, wherein said panel engaging surface comprises an elongated bulge member.

5. The extruded snap frame panel arrangement as recited in claim 4, wherein said elongated bulge member is co-extruded with said curved snap frame plate.

6. The extruded snap frame panel arrangement as recited in claim 5, wherein said elongated bulge member is comprised of a material of a lower durometer than said curved snap plate.

7. The extruded snap frame panel arrangement as recited in claim 6, wherein said cover plate has a first channel with an elongated guide point thereon to maintain an curved outer gripping lip engageable with a first channel on said front frame plate.

8. The extruded snap frame panel arrangement as recited in claim 7, wherein said curved snap plate has a planar face on a T-shaped outer gripping lip thereon which T-shaped outer gripping lip lies flat against a second channel on said cover plate when said snap frame panel arrangement is in a closed configuration.

9. The extruded snap frame panel arrangement as recited in claim 7, wherein said first channel on said cover plate and said elongated T-shaped gripping lip define a first plane, and said elongated living hinge lies outside of said first plane when said snap frame arrangement in a closed configuration.

10. A method of supporting a display panel in a biased flat orientation comprising:

providing an elongated forwardly-curved back frame plate and an elongated curved snap plate in an integrally connected configuration;

sliding an elongated cover plate onto said curved snap plate;

inserting an elongated display panel onto a front face of said forwardly-curved back frame plate; and pivoting said curved snap plate towards said forwardly-curved back frame plate about an elongated primary hinge arranged therebetween to provide a multiple bias onto said display panel between said forwardly-curved back frame plate and said curved snap plate.

11. The method as recited in claim 10, including:

biasing said forwardly-curved back frame plate against said elongated display panel to provide a pinching therebetween and maintain said elongated display panel in a flat condition.

12. The method as recited in claim 10, including:

rotating a first channel and a second channel of said cover plate about an elongated curved outer gripping lip and an elongated T-shaped gripping lip respectively as said curved snap plate is pivoted about said elongated primary hinge.

13. The method as recited in claim 10, including:

biasing said curved snap plate into a closed pinching configuration against a display panel by biasing said cover plate against said curved snap plate.

* * * * *